United States Patent [19]

Payne et al.

[11] Patent Number: 4,980,024

[45] Date of Patent: Dec. 25, 1990

[54] ANTISKID PAPER WITH ENHANCED FRICTION RETENTION

[75] Inventors: Charles C. Payne, Aurora; Raymond J. Novotny, Arlington Hts.; Roger H. Jansma, Park Forest; Neil A. Marron, Naperville, all of Ill.

[73] Assignee: Nalco Chemical Company, Naperville, Ill.

[21] Appl. No.: 351,709

[22] Filed: May 15, 1989

[51] Int. Cl.[5] ..... D21H 19/56

[52] U.S. Cl. ..... 162/135; 162/158; 162/168.3; 162/181.6; 427/391; 427/395; 427/397.7; 428/452; 428/511

[58] Field of Search ..... 162/135, 158, 168.3, 162/181.6; 106/36; 428/452, 511, 391, 395, 397.7

[56] References Cited

U.S. PATENT DOCUMENTS 3,860,431 1/1975 Payne et al. ..... 106/36

*Primary Examiner*—Peter Chin

*Attorney, Agent, or Firm*—Kinzer, Plyer, Dorn, McEachran & Jambor

[57] ABSTRACT

Superiority in retained slide angle of antiskid paper is achieved by spraying the paper with a composition of matter consisting essentially of an acrylamide, glycerine, balance antiskid aqueous silica sol.

6 Claims, No Drawings

ANTISKID PAPER WITH ENHANCED FRICTION RETENTION

INTRODUCTION

This invention relates to the coating of paper to increase its surface friction (antiskid properties) and in particular to paper in the form of so-called liner board employed in the manufacture of corrugated boxes.

BACKGROUND OF THE INVENTION; PRIOR PRACTICES

There are circumstances where it is advantageous to employ paper having enhanced friction at the surface. Paperboard liner for cardboard (corrugated) boxes is an example, as in the case of shipping or otherwise transporting stacked boxes containing expensive goods, or goods easily susceptible to damage in the event the stack topples. This problem can be surmounted to a considerable extent if the surfaces of the boxes are treated to increase their friction, meaning more resistance to sliding.

The same case prevails in the manufacture of box blanks. The two liner boards are adhesively joined to opposite sides of the fluted center in a continuous production stream. The three components (two outside liner boards and one fluted inside center) are supplied from separate winders at the board plant and are continuously combined at a juncture or confluence after being coated with an adhesive to secure the lamination; afterwards the continuous, laminated, corrugated board is die cut and scored to comply with the box geometry. The clones are separated and stacked flat; again it is advantageous that the exposed liner surfaces be treated to increase the friction, to keep the stack in a neat order.

It will be appreciated a similar case applies for the benefit of frictionizing paper (Kraft) bags.

The proposition of treating the liner board by spraying it with a friction enhancer is not new: U.S. Pat. Nos. 3,649,348, 3,689,431 and 3,860,431. Further, in U.S. Pat. No. 4,418,111 it is proposed to rely on a mixture of silica sol and urea. The urea is said to preserve the frictioned surface against loss of friction coefficient, that is, the slide angle is less susceptible to decline as a result of rewinding the paper.

It may also be mentioned in connection with the foregoing that either at the paper mill or board manufacturing plant the friction properties of the paper are tested for the so-called slide angle as will later be described in detail.

SUMMARY OF THE INVENTION

We have found that superiority in retained friction properties at the surface of a sheet of paper may be achieved by spraying or otherwise coating the sheet with a composition of matter consisting essentially of silica sol, glycerine and an acrylamide homopolymer.

DETAILED DISCLOSURE

The friction at the obverse side (face) of a sheet of paper is industrially tested by securing one sheet, with its face up, to a support. A second like sheet is juxtaposed to the first, face down, so that the frictioned surfaces engage. A weight is imposed on the back of the second sheet. The support has a pivot at the fore end and a lifting force is applied to the aft end, resulting in an increasing incident angle. When the weighted sheet starts to slip, the incident slide angle is measured as an analog of the frictional resistance. The slide angle is considered in the art as the characteristic of the antiskid quality of the sheet.

To be sure a representative average is involved, the width of the roll is sampled across its width at three places: front, center and back (F,C,B). The foregoing is a broad outline of the slide angle test. The equipment and procedure are described in more detail in U.S. Pat. No. 3,689,431.

The ability of the sheet to retain its slide angle is important. The paper mill ships the paper in very large rolls (e.g. reels 300Δ wide and 8–10′ in diameter) to the board manufacturer where the rolled sheet is split across its width into smaller sheet widths (say three or four) and these are rewound on winders.

The paper may vary in weight, 33, 42 and 69 pounds per thousand square feet are examples. Winding, unwinding and rewinding may loosen the silica particles so that the initial slide angle is considerably reduced. It is of no benefit to have a good initial slide angle, only to find later that the angle has diminished as a result of repeated winding and rewinding.

We practice so much of the prior art as involves use of a silica sol, that is, an aqueous dispersion of silica solids, heretofore employed to impart antiskid properties to paper. The particles are small and always have been, being measured in terms of nanometers. The particle sizes and concentration in the sol have been fairly well established, from as small as five or ten to as much as one hundred or one hundred twenty nanometers. What we believe to be new under our invention is the enhancement of retention of friction effected by combining the silica sol with glycerine and an acrylamide homopolymer. The unexpected results will be perceived from the following examples and comparisons. The comparisons were made at the facilities of manufacturers. All parameters effecting results had to be and were equal within experimental error and tolerance allowances at the plant, including paper weight and grade, silica particle size and dry weight and uniformity of application.

PREFERRED EMBODIMENTS

We have tested with consistent success in the field a combination of silica sol, glycerine and acrylamide polymer, examples 1 and 2.

EXAMPLE 1

| Ingredient | Weight % |
|---|---|
| Colloidal Silica | 92.95 |
| Glycerine | 2.00 |
| Polyacrylamide (homopolymer) | 5.00 |
| Preservative | 0.05 |

The colloidal silica is forty percent by weight silica particles (average particle size about seventy nanometers) balance water. The glycerine (glycerol) is an industrial grade of 99.5% purity.

The polyacrylamide has a molecular weight in the range of 10,000 to 30,000. The preservative (biocide) has no effect on slide angle performance.

EXAMPLE 2

This is the same as Example 1 except for the percent solids in the silica sol (40.34) and an average particle size of about sixty nanometers.

The two products (Examples 1 and 2) were compared to treatments already on the market.

COMPARISON A

Product A was a commercial antiskid product composed of about eighty four percent by weight silica sol and sixteen percent by weight urea, in which the silica particles average about thirty-five nanometers in size, representing about thirty-five to forty percent by weight of the aqueous sol.

Product A and Example 1 were so applied to test sheets at the plant of a box-maker (January) that the flow rate and therefore effective weight amount of silica particles per unit area were equal for performance characteristics. In other words, the comparison test was so conducted that any difference in performance would be due to the combination of glycerine and acrylamide (Example 1) compared to the urea in Product A. The weight of the paper was 42#. The test sheets when dry (F,C,B) were compared for loss in slide angle after five slides, which is an accepted comparison for retention of initial friction. A negative value means an increase (unexpected) in slide angle retention.

| Test Sample | Slide Angle Loss (Decline) |
|---|---|
| Product A | 1.6 |
| | 0 |
| | 1.3 |
| | 0.66 |
| | 2.7 |
| | 1.25 (average) |
| Example 1 | −0.33 |
| | −1.25 |
| | 0 |
| | 2.3 |
| | 0.18 (average) |

In a second test at the same plant (April) on 42# paper, paper treated with Product A showed a decline of 6° (four F,C,B tests averaged) compared to Example 1 where the average decline or loss of initial angle for the same paper (seven F,C,B tests) was only 1.54°.

COMPARISON B

Example 2 was compared at a second board maker plant (May) to another product on the market, Product B. Product B was an aqueous silica sol combined with a little caustic for pH control. The average silica particle size was forty to forty-five nanometers; the sol was fifty percent silica solids. In this comparison, slide angle measurements for antiskid retention were made after transferring the paper (42#) from the Reel to the Winder, rewinding in other words, as explained above. The initial slide angle was measured for the Reel paper; retention was measured using the Winder paper. The paper coated with Product B showed a loss of 2.2°; that for Example 2 showed a gain of 1.7°. The initial slide angle for paper coated with Example 2 was 26°; for Product B 25.8°.

Another comparison using Product B was also made at the second plant (November, December), again measuring retention of the slide angle after being transferred from the Reel to the Winder. The paper weight was 42#. The paper coated with Example 2 showed an average loss of only 1° (loss or decline in initial slide angle) while paper coated with Product B showed an average loss of 5.9°.

Comparisons of the same order were observed for liner board of 33# and 69# weight. In all comparisons, the application dosage was in the neighbord of about eight to twelve pounds per ton of paper, applied by spray heads of known construction at the manufacturer's plant. The tests of course were undertaken after the antiskid spray coating had dried; indeed after the paper had been wound.

We observed little improvement in slide angle retention when the amount of acrylamide was in the range of two to three percent. An increase to six percent by weight showed no economic advantage and consequently about five percent by weight of acrylamide is deemed optimum when combined with about two percent by weight of glycerine. Though we have described preferred embodiments of the invention, using these amounts, while varying the silica particle size slightly (a range of about forty to seventy nanometers, deemed optimum for paper weights of 33/69#) it is to be understood that these values are capable of variation because the effect of glycerine combined with acrylamide is not dependent on paper weight, or silica particle size, or the concentration silica in the antiskid sol, the sol being selected for its established ability to impart a good antiskid initial slide angle.

The acrylamide polymer may be non-crossslinked but it is preferred that it is crosslinked. The polyomer is conveniently handled as an aqueous solution of about 25% by weight solids. The solubility of the acrylamide polymer depends upon the degree of cross-linking, which should not be so great that a solution of about 25% by weight solids cannot be obtained. It is possible that polymers of lower or higher molecular weight can be used together with a viscosity reducing additive if needed. Suitable viscosity reducing additives include sodium phosphate and sodium sulphate. It is also possible that anionic character can be imparted to the polyacrylamide.

Any known cross-linking agent for acrylamide polymers can be used; N,N'-methylene-bis-acrylamide is mentioned as a preferred example. Other crosslinking agents include, for example N,N'-methylene-bis-methacrylamide, other lower alkylidene bis-acrylamides, divinyl benzene sulfonate, ethylene glycol diacrylate, ethylene gylcol dimethacrylate, diallyl ethylene glycol ether, divinyl esters of polyethylene glycol (e.g. polyethylene glycol-600 diacrylate), divinyl eters of polyethylene glycol (e.g. polyethylene glycol-600 diacrylate), divinyl ethers of polyethylene glycol and the like difunctional monomer containing two $CH_2{=}C$ groupings which are to some extent soluble in the aqueous phase. Mention is further made of adducts of glycerine and allyl glycidyl ether and adducts of allylamine and a copolymer of maleic anhydride and methyl vinyl ether with different mole ratios of allylamide to anhydride.

The acrylamide polymer is made in a known manner. The preferred polyacrylamide homopolymer is prepared from the following components, by weight:

| | |
|---|---|
| Acrylamide solution 50% | 50.00 |
| Water | 45.3243 |
| N,N'-methylene-bis-acrylamide | 0.0017 |
| EDTA, tetrasodium salt - 50% | 0.0240 |
| Ammonium persulphate | 0.750 |
| Water | 1.400 |
| Sodium bisulphate | 0.750 |
| Water | 1.700 |
| Biocide | 0.050 |
| | 100.000 |

The acrylamide solution, water, N,N'-methylene-bis-acrylamide crosslinking agent and the EDTA sodium salt are first mixed to form a solution. The ammonium persulphate, in solution in water, is then added to the monomer solution and mixed vigorously. Thereafter the sodium bisulphite solution is added so that redox initiation commences. The polymerization reaction proceeds adiabatically. With the exothermic reaction complete the temperature peaks at about 90–95° C. After cooling the biocide is added.

The EDTA serves as a chelating agent to complex any polymerization inhibitors present in the acrylamide monomer, for instance copper compounds. Other chelating agents, for example trinitriloacetic acid, sodium salt, can be used and if no polymerization inhibitor is present a chelating agent can be dispensed with. The ammonium persulfate and the sodium disulfite act as polymerization initiators and catalysts. Other initiators and catalysts can of course be used.

Hence while we have disclosed the preferred embodiments of the invention it is to be understood that variations and modifications can be adopted with equivalent results.

We claim:

1. A method of reducing slide angle loss for antiskid paper products consisting of the step of coating the paper with a composition of matter consisting essentially of about two percent by weight glycerine, five percent by weight polyacrylamide of molecular weight about 10,000 to 30,000, balance substantially aqueous antiskid silica sol.

2. Method according to claim 1 in which the average particle size of the silica solids is about 5 to 120 nanometers.

3. Method according to claim 2 in which the weight percent solids in the silica sol is about 40 and in which the average particle size is about 40 to 70 nanometers.

4. Paper product coated with a composition of matter for enhancing the slide angle retention of the paper product, said composition of matter consisting essentially of about two percent by weight glycerine, five percent by weight polyacrylamide of molecular weight about 10,000 to 30,000, balance substantially aqueous antiskid silica sol.

5. Paper product according to claim 3 in which the average particle size of the silica solids is about 5 to 120 nanometers.

6. Paper product according to claim 5 in which the weight percent solids in the silica sol is about 40 and in which the average particle size is about 40 to 70 nanometers.

* * * * *